United States Patent [19]

Jarvis

[11] Patent Number: 4,958,759

[45] Date of Patent: Sep. 25, 1990

[54] COMBINED BOOK COVER BOOK CARRIER

[76] Inventor: Irene Jarvis, P.O. Box 021770, Brooklyn, N.Y. 11202

[21] Appl. No.: 352,886

[22] Filed: May 17, 1989

[51] Int. Cl.[5] ..... A45F 5/12

[52] U.S. Cl. ..... 224/151; 294/138

[58] Field of Search ..... 224/151, 153; 150/154; 281/45, 29, 19.1; 294/138, 141, 150, 151

[56] References Cited

U.S. PATENT DOCUMENTS 737,969 9/1903 Schrenk ..... 294/138
745,251 11/1903 Sleght ..... 294/138
754,227 3/1904 Moog ..... 294/138 X

FOREIGN PATENT DOCUMENTS 80550 8/1952 Norway ..... 224/153

*Primary Examiner*—Renee S. Luebke
*Attorney, Agent, or Firm*—T. M. Gernstein

[57] ABSTRACT

A combined book cover and book carrier includes straps that are movably mounted on a body to accommodate books of varying size and handles that include extension straps so the cover and carrier can be carried in the user's hand, on his wrist, over his shoulder or on his back.

2 Claims, 1 Drawing Sheet

COMBINED BOOK COVER BOOK CARRIER

TECHNICAL FIELD OF THE INVENTION

The present invention relates to the general art of article carriers, and to the particular field of book carriers.

BACKGROUND OF THE INVENTION

Many people enjoy reading so much that they often take a book with them as they perform errands, travel, or the like. This permits them to read while they are waiting for buses, trains, doctor's appointments, or the like. If they take their book to work, they can read on their lunch hour, their coffee break, or the like.

However, when carrying a book in this manner, the book, not only gets in the way, especially if the person is carrying other packages or if the person happens to be on crutches, the book also tends to get lost, or simply left behind when the person sets it down to carry out other tasks. Furthermore, the book is often simply stuffed into a bag, carrying case, purse or the like, and thus tends to get damaged.

Accordingly, there have been several designs proposed for a combined book cover and book carrier, see, for example, U.S. Pat. Nos. 2,523,129 and 4,036,417. While somewhat successful, covers of this type have several drawbacks which prevent them from achieving full commercial success. Principal among such drawbacks is the limited versatility of such devices. That is, they can only snugly accommodate a single book size. Since books come in a wide variety of sizes, most of the books carried in these known devices will be only loosely held, and will be susceptible to slipping and sliding about within the cover. This is an inconvenience at best, and could contribute to the damage or loss of a book at worst.

Still further, presently known devices are not amenable to being carried in a variety of ways, but only have handles. Thus, if the user has several packages, or is on crutches, these known book carriers are just another package, and might even be considered as being a nuisance.

Accordingly, there is a need for a combination book carrier and book cover that is adaptable to a wide variety of book sizes and carrying situations.

OBJECTS OF THE INVENTION

It is a main object of the present invention to provide a combination book carrier and book cover that is adaptable to a wide variety of book sizes and carrying situations.

It is another object of the present invention to provide a combination book cover and carrier that is attractive.

It is a specific object of the present invention to provide a combination book cover and book carrier that can be carried in a user's hand, on his wrist, over his shoulder, or on his back.

It is another specific object of the present invention to provide a combination book cover and book carrier that can accommodate both large and small books in a snug manner.

SUMMARY OF THE INVENTION

These, and other, objects are achieved by providing a combination book cover and book carrier that has handles that are adjustable for use in the user's hand, on his wrist, over his shoulder or on his back, and has adjustable straps that can be moved to accommodate both large and small books in the combined cover and carrier in a snug manner.

Since the handles and book holding elements of the device have a variety of different configurations, the various elements of the combined book cover and carrier can be colored or designed to be attractive to any specific portion of the population, such as children, women or men.

DESCRIPTION OF THE FIGURE

The single FIG. is a perspective view of the combined book cover and book carrier embodying the invention in an open condition ready to receive a book.

DETAILED DESCRIPTION OF THE PREFERRED EMBODIMENT OF THE INVENTION

Figure 1:
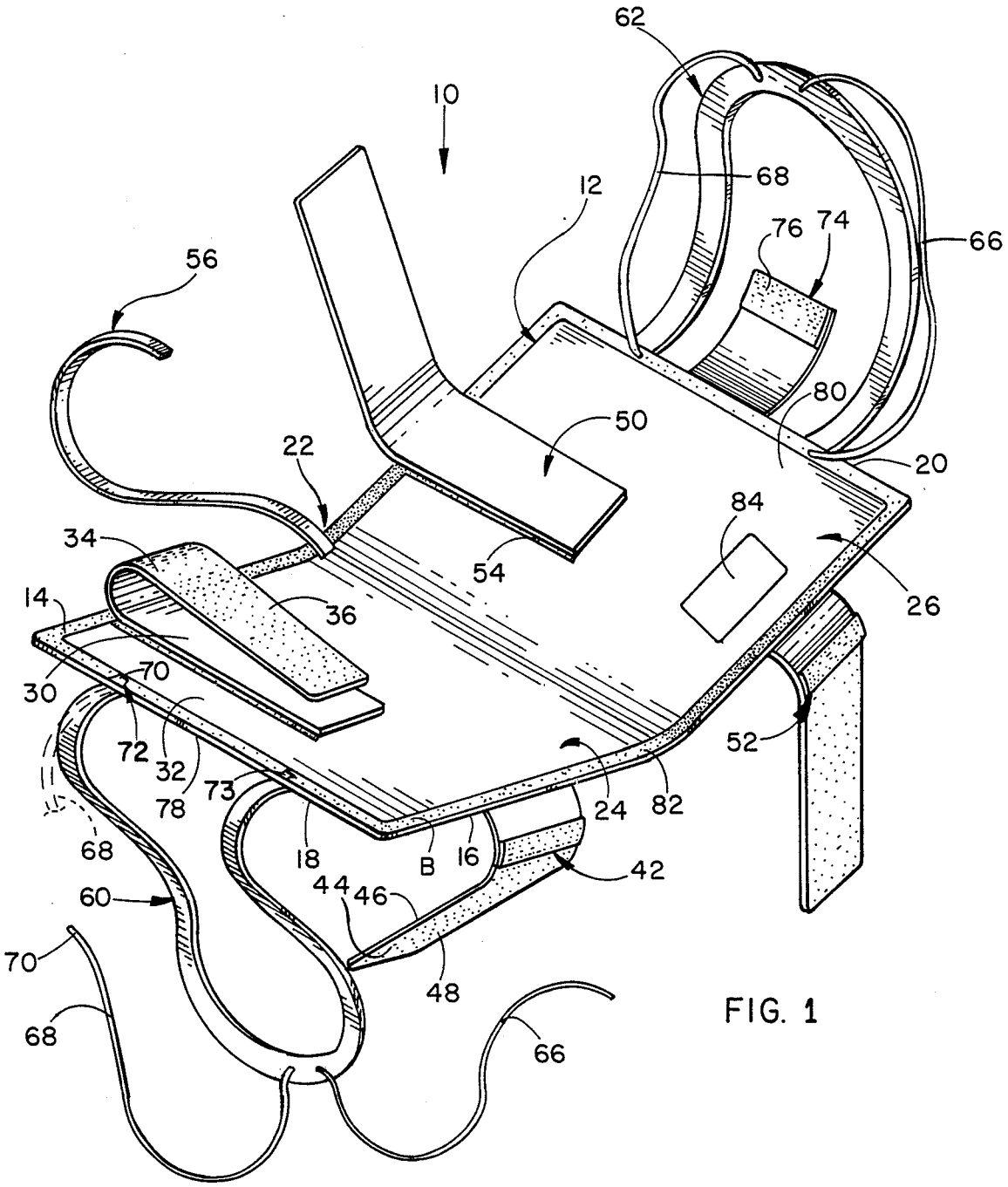

Shown in the FIG. is a combined book cover and book carrier 10 that includes a body 12 made of flexible material, and having two side edges 14 and 16 and two end edges 18 and 20 with a spine section 22 being located intermediate the end edges 18 and 20 and extending from one side edge to the other side edge to divide the body 12 into two equal sized portions 24 and 26. The spine section 22 is flexible so that portion 24 can be folded over portion 26 to be congruent therewith and to place end edge 20 on top of end edge 18 to close the body. For the purposes of this disclosure, it will be assumed that the body 12 has a width dimension that is measured between end edges 18 and 20 and a length dimension that is measured between side edges 14 and 16.

The combined book cover and book carrier 10 also has a book holding means on the body. The book holding means includes a first strap 30 attached to inner surface 32 of the portion 24 approximately intermediate the spine section 22 and end edge 18. the first strap 30 is elongate and has a rear surface 34 that is located to engage the inner surface 32 and which includes hook and loop fastening means 36 thereon. The inner surface 32 also has hook and loop fastening means thereon so the first strap 30 is movably, but securely affixable to the body at various locations along the length dimension of the body. Moving the first strap along the length dimension of the body will permit that strap to be snugly secured about books having either a large or a small length. The strap can also be moved toward or away from the spine section 22 to accommodate books having a small or a large width. The fastening means on the inner surface 32 is large enough to permit such lengthwise and widthwise movement of the strap 30. This size is indicated in FIG. 1 by the area 40 located adjacent to the strap 30. The first strap 30 has a length that exceeds one half the length of the cover 12 so a wide variety of book sizes can be accommodated.

The book holding means further includes a second strap 42 that is hingeably connected at one end thereof to body side edge 16 to be located approximately intermediate between the spine section 22 and the end edge 18. The second strap 42 also includes an inner surface 44 and an outer surface 46, with hook and loop fastener means 48 being located on the inner surface 44. The second strap is also elongate and has a length that exceeds one-half of the width of the body.

The hook and loop fastener means 48 on the second strap 42 co-operates with the hook and loop fastener means 36 on the first strap 30 to releasably connect those two straps together. A book can thus be captured between such coupled straps, and the straps can be adjusted to snugly secure the book into the body.

Third and fourth straps 50 and 52 are similarly designed, located and attached to the second portion 26 to adjustably connect together and snugly hold the other portion of a book to the cover second portion 26, with the spine of the book approximately congruent with the spine section 22 of the body 12. Additional fastener means 54 is also included with the portion 26 to permit the third strap 50 to be moved to accommodate small books.

A book mark 56 is a flexible elongate strip of material that is attached at one end thereof to the body adjacent to the spine section 22 and adjacent to the first side 14. The book mark 56 is used in the usual manner.

The combined book cover and book carrier 10 further includes a carrying means that includes first and second flexible handles 60 and 62 which are fixedly attached to the body along end edges 18 and 20 respectively to be located approximately intermediate the side edges 14 and 16. The handles are each attached at the ends thereof to the body to form handle-like loops which are sized to be carried over either the wrist or to be grasped and carried in the user's hand.

The carrier means also includes additional means that permit the combined cover and carrier 10 to be carried either on the user's back or over his shoulder. This additional means includes two extension elongate straps 66 and 68 on each handle. Each strap is fixedly attached at one end thereof to the handle near the midpoint of such handle, and has hook and loop fastener means, such as means 70, on the other, distal, end thereof. The body 12 has corresponding hook and loop fastener means, such as means 72 and 73, thereon in a border B adjacent to the handles. The strap 68 is shown in phantom lines when means 70 is releasably attached to the means 72. The straps are releasably attached to the body adjacent to the handles in a stored configuration shown for handle 62, and are released therefrom to be deployed as shown for the handles 60. Once deployed, the straps 66 and 68 can be extended over a user's shoulder so the device 10 can be carried in an over-the-shoulder fashion, or can be tied together at the distal ends thereof to form a large loop that is sized to have the user fit his arm through so the device 10 can be carried in knapsack-fashion with the tied-together straps 66 and 68 forming a shoulder harness through which a user fits his arms and which acts as a shoulder strap in use as a knapsack. The straps can be tucked inside the device 10 when not in use to form shoulder straps.

The combined book cover and book carrier 10 further includes a closure fastening means which includes a flexible strap 74 attached at a proximal end thereof to the body adjacent to the end edge 20 and approximately intermediate the side edges 14 and 16, and having hook and loop fastening means 76 thereon near a distal end thereof. The body also includes a corresponding hook and loop fastening means 78 thereon near the end edge 18 on the outer surface of the body to co-operate with the fastening means 76 to releasably close the device 10.

The device 10 also includes a lining 80 that is fixedly attached to an outer cover 82 and is sized to form the boarder B, and a pouch 84 is affixed to the lining to accommodate an identification card in case the device is lost. The cover and the lining are formed of any material suitable for protecting any items stored in the device 10. Such materials will be evident to those skilled in the art based on the teaching of the present disclosure.

It is understood that while certain forms of the present invention have been illustrated and described herein, it is not to be limited to the specific forms or arrangements of parts described and shown.

I claim:

1. A combined book cover and book carrier comprising:

(A) a body having
  (1) first and second side edges and a length dimension as measured between said first and second side edges,
  (2) first and second end edges and a width dimension as measured between said first and second end edges,
  (3) an inner surface,
  (4) an outer surface, and
  (5) a foldable spine section located intermediate said end edges and extending from said first side edge to said second side edge and dividing said body into first and second portions, said spine section being foldable to permit said first section to be placed on top of said second section;

(B) a book holding means including
  (1) first, second, third and fourth straps attached to said body, with said first and second straps being identical and said third and fourth straps being identical,
  (2) each of said first and second straps being elongate and including an upper surface and a lower surface with fastener means being positioned on said lower surface, said body including fastener means on said body inner surface, and the fastener means on said first and second straps being attached to said body inner surface by said body fastener means,
  (3) each of said third and fourth straps being elongate and being connected to said body adjacent to said body second side and having an upper surface and a lower surface, and having fastener means on said strap upper surface, said third and fourth straps being located approximately intermediate between said spine section and a corresponding one of said body end edges, and having the fastener means on said third and fourth straps co-operating with the fastener means on said first and second straps to releasably couple said third and fourth straps to said first and second straps;

(C) a book mark including an elongate strap attached at one end thereof to said body adjacent to said spine section;

(D) carrying means which includes
  (1) first and second handles each attached to said body adjacent to said body end edges to form loops,
  (2) first second, third and fourth elongate extension straps each fixedly attached at one end thereof to said handles near the middle of said handles, and each having fastener means on another end thereof, and
  (3) fastener means on said body adjacent to said handle for co-operating with said fastener means on said extension straps to releasably hold said extension straps in place; and (E) closing fastener means on said body and including (1) a strap attached at one end thereof to said body second end edge and having fastener means thereon, and (2) fastener means on said body adjacent to said body first end edge for co-operating with the fastener means on said closing fastening means strap.

2. The combined book cover and book carrier defined in claim 1 wherein all of said fastener means are hook and loop fastener means.

* * * * *